United States Patent [19]

Jackson

[11] Patent Number: 4,981,262

[45] Date of Patent: Jan. 1, 1991

[54] UNIT FOR SUPPLYING COMBUSTION AIR TO A FURNACE

[76] Inventor: Bert W. Jackson, 1219 Garfield Rd., Lansing, Mich. 48917

[21] Appl. No.: 392,895

[22] Filed: Aug. 14, 1989

[51] Int. Cl.[5] ..... F24D 3/08; F23L 17/00

[52] U.S. Cl. ..... 237/19; 110/162; 110/163; 126/85 B

[58] Field of Search ..... 110/162, 163, 206, 207; 126/85 B; 431/215; 237/19

[56] References Cited

U.S. PATENT DOCUMENTS

| | | | |
|---|---|---|---|
| 2,877,724 | 3/1959 | Arvintz et al. | 110/162 |
| 3,964,675 | 6/1976 | Euchner Jr. | 110/162 |
| 4,205,631 | 6/1980 | Parker | 110/162 |
| 4,262,608 | 4/1981 | Jackson | 110/162 |
| 4,290,552 | 9/1981 | Prikkel III | 110/163 |
| 4,424,792 | 1/1984 | Shimek et al. | 110/162 |
| 4,449,569 | 5/1984 | Lisi et al. | 110/162 |

OTHER PUBLICATIONS

Trade Literature—Honeywell Tradeline Controls Form #95-6247.

*Primary Examiner*—Henry C. Yuen
*Attorney, Agent, or Firm*—Ian C. McLeod

[57] ABSTRACT

An improved unit (10) which supplies combustion air (A) to a furnace (100) or hot water heater (200) is described. The unit includes a switch (59) which continues the operation of motor (14) and fans (12 and 15) in unit (10) until the hot flue gases (H) are vented and to cool exhaust gas pipe (22) after the furnace and/or hot water heater cease to operate to produce heat.

18 Claims, 3 Drawing Sheets

UNIT FOR SUPPLYING COMBUSTION AIR TO A FURNACE

Figure 1:
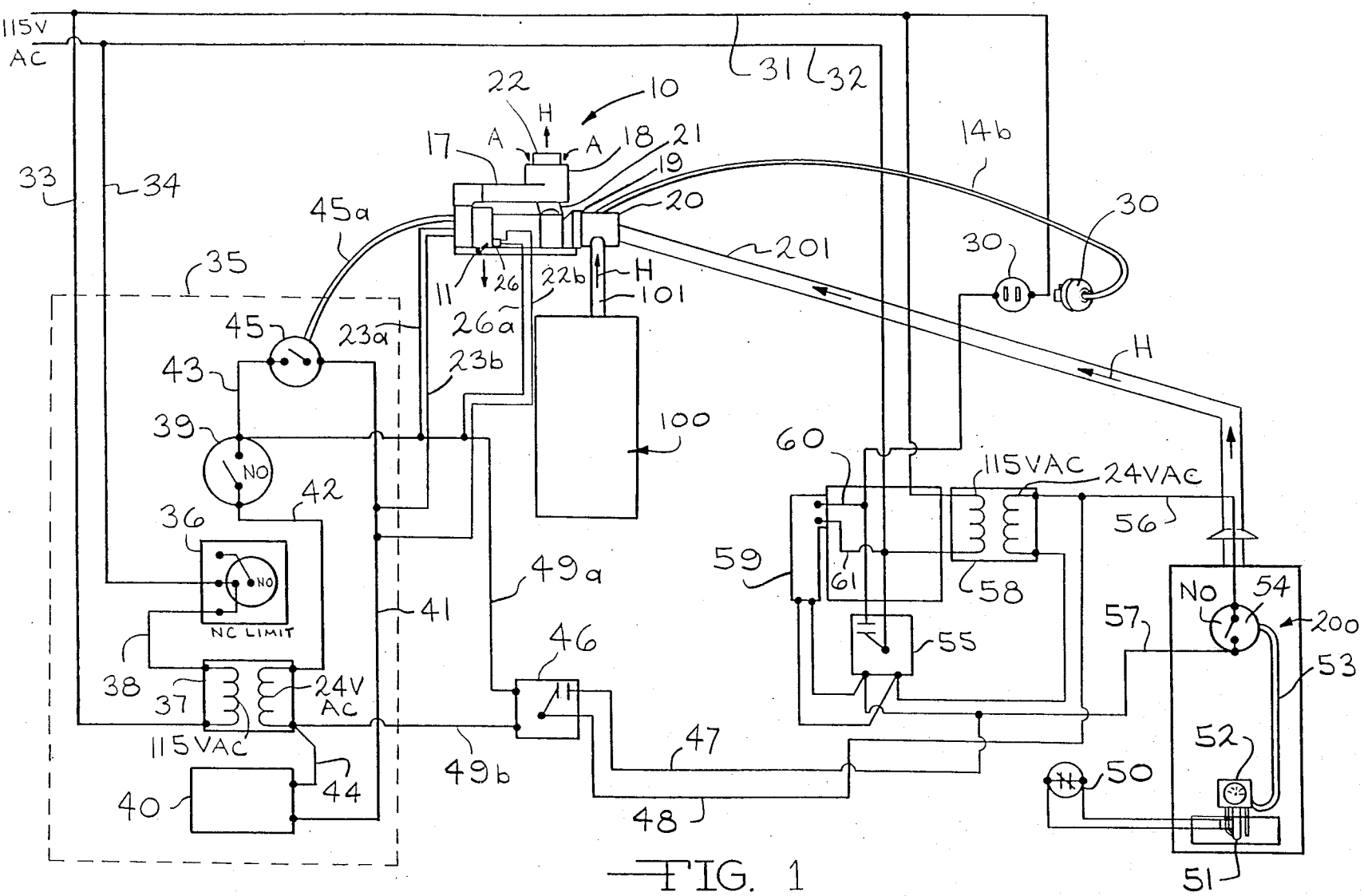

BACKGROUND OF THE INVENTION (1) Field of the Invention

The present invention relates to an improved unit which in operation supplies combustion air to a furnace and/or to a hot water heater from outside of a building and which when not in operation is closed to the outside of the building. In particular the present invention relates to a unit which preheats combustion air to the furnace and which continues to operate after the furnace and/or heater cease to generate heat to insure venting of the hot flue gases from the furnace or hot water heater.

(2) Prior Art

My U.S. Pat. No. 4,262,608 is believed to show the closest prior art. As shown in FIG. 10, the motor 16 in unit 10 operates while a gas furnace is operating. The unit 10 operates very well; however, there is a concern that when the dampers 39 and 40 close after the operation of the unit, there may be trapped hot flue gases which are prevented from escaping from the furnace or hot water heater with the result that they can leak from the furnace or hot water heater into the basement or other room housing this equipment. The dampers 39 and 40 are necessary to prevent cold outside air from coming into the building when the motor 16 is stopped. Various solutions were conceived; however, none provided positive control over the operation of the motor 16 in unit 10 to allow safe evacuation of the flue gases after the furnace and/or hot water heater burners stopped producing heat.

OBJECTS

It is therefore an object of the present invention to provide a unit which preheats combustion air for a gas furnace and which has dampers for closing the air inlet pipe and hot flue gas pipe when the furnace and/or hot water heater are not in operation, but only after the flue gases are vented from the furnace and/or hot water heater. Further, it is an object to provide a device which is simple to construct and which is safe in operation. These and other objects will become increasingly apparent by reference to the following description and the drawings.

IN THE DRAWINGS

FIG. 1 is an electrical and gas flow diagram showing a unit 10 for preferably providing outside air A to adjacent to the furnace 100 and optimally adjacent the hot water heater 200 and for venting the flue gases H from the heater 200 and for furnace 100.

Figure 2:
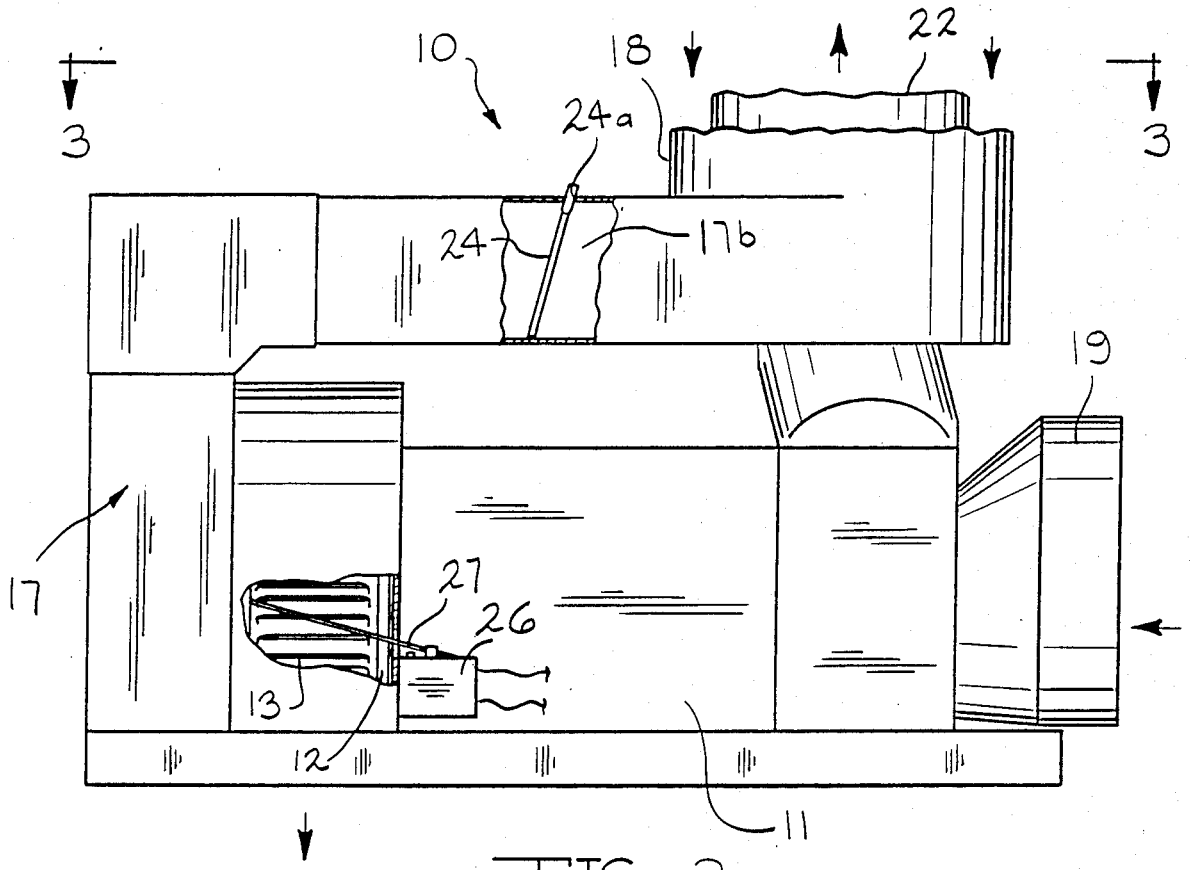

FIG. 2 is a front view of the unit 10 of FIG. 1 particularly showing a flow controlled damper 24 for the inlet air supply pipe 18 and a flag 27 on a sail or flag switch 26 for determining sufficient air flow in the compartment 12 of the unit 10.

Figure 3:
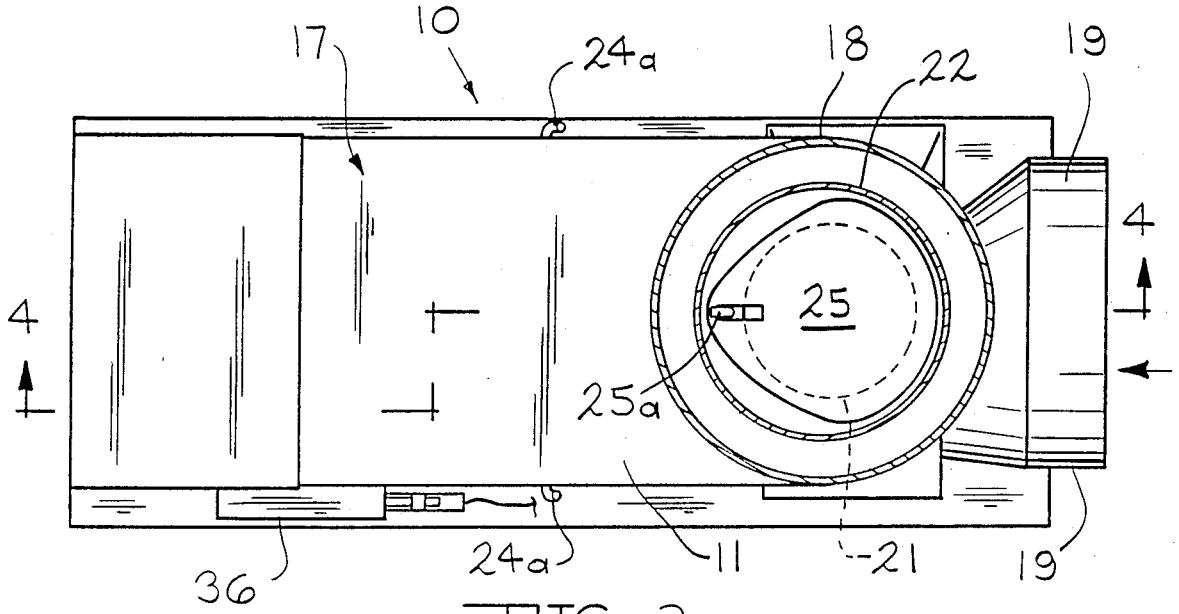

FIG. 3 is a plan view of the unit 10 of FIG. 1 particularly showing a damper 25 for the hot flue exhaust pipe 22.

Figure 4:
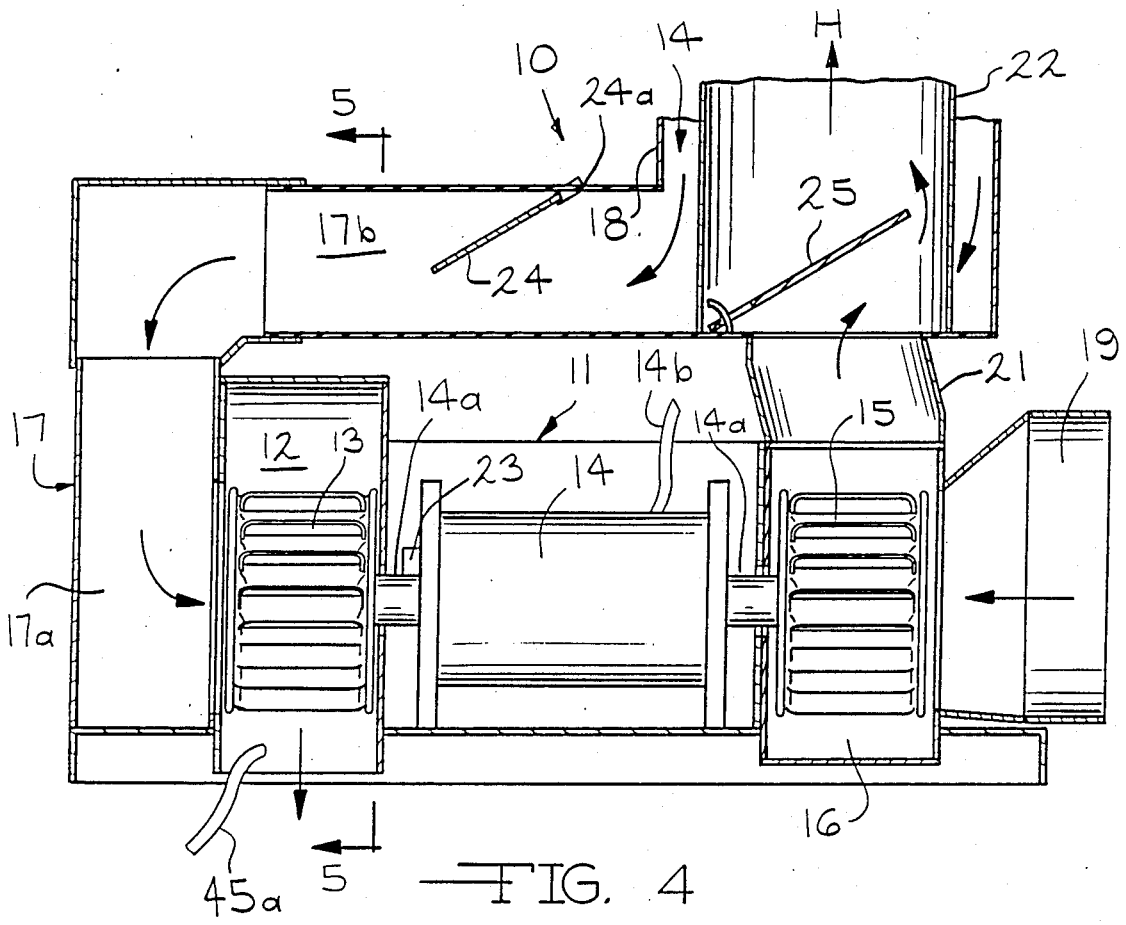

FIG. 4 is a front cross-sectional view along line 4—4 of FIG. 3 showing a motor 14 driving the fans 13 and 15 which cause the flow of inlet air A and of exhaust flue gas H and showing the dampers 24 and 25 which are opened by the air flow A and exhaust gas flow H, respectively.

Figure 5:
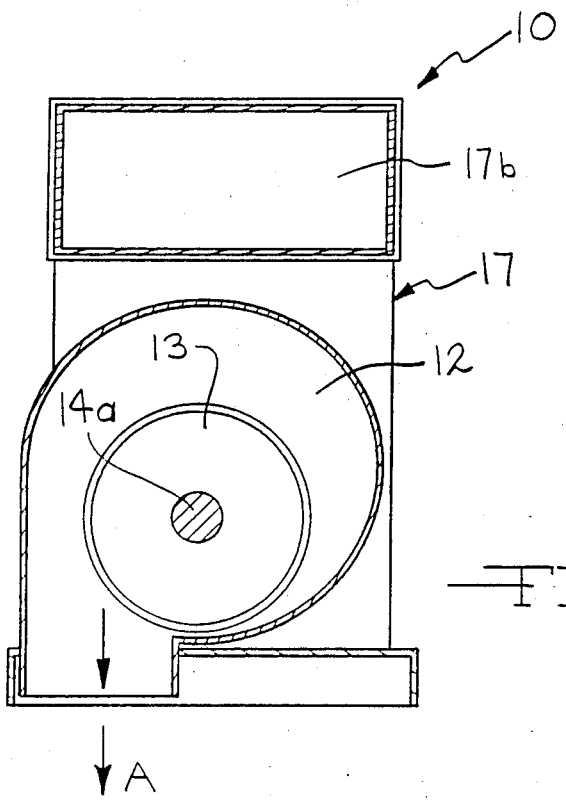

FIG. 5 is a side view along line 5—5 of FIG. 4 showing the preferred scroll configuration of the chamber 12 having the fan 13 for the inlet air A supply.

GENERAL DESCRIPTION

The present invention relates to an improved control system for a unit which supplies combustion air to a heating furnace and optionally to a hot water heater wherein the unit has a compartmented main housing, said main housing defining a combustion air supply compartment and flue products exhaust compartment therein, said combustion air supply compartment provided with a combustion air intake fan mounted therein and said flue products exhaust compartment provided with a flue products exhaust fan mounted therein; drive means to drive said combustion air intake fan and said flue products exhaust fan; an outside air intake pipe provided on said main housing in open communication with said combustion air supply compartment, said outside air intake pipe configured to extend to the exterior of the building in which it is mounted so as to provide outside air to said combustion air supply compartment; a flue products exhaust pipe provided on said main housing in open communication with said flue products exhaust compartment, said flue products exhaust pipe configured to extend to the exterior of the building to deliver hot flue products to the outside atmosphere; and damper means provided in said combustion air intake pipe and said flue products exhaust pipe so as to selectively close said intake air and flue products exhaust pipes when said fans are not running which comprises: first switch means connected to the unit which closes upon activation of the drive means to enable a circuit controlling operation of a gas supply valve in the heating furnace and which opens to disengage the circuit when the drive means is stopped; and second switch means which is closed to continue the operation of the drive means to the exhaust fan for a period of time after the operation of the heater or furnace are completed to provide complete removal of the hot flue products from the exhaust pipe, unit and furnace and then opens.

Further the present invention relates to An improved control system for a unit which preheats combustion air to an area around a heating furnace and optionally air to a hot water heater adjacent the furnace wherein the unit has a compartmented main housing, said main housing defining a combustion air supply compartment and flue products exhaust compartment therein, said combustion air supply compartment provided with a combustion air intake fan mounted therein and said flue products exhaust compartment provided with a flue products exhaust fan mounted therein; a double-shafted drive motor mounted in said main housing so as to simultaneously drive said combustion air intake fan and said flue products exhaust fan; an outside air intake pipe provided on said main housing in open communication with said combustion air supply compartment, said outside air intake pipe configured to extend to the exterior of the building in which it is mounted so as to provide outside air to said combustion air supply compartment; a combustion air supply duct provided on said main housing in open communication with said combustion air supply compartment, said combustion air supply duct configured to convey combustion air to the furnace area; a flue products exhaust supply duct provided on said main housing in open communication with said flue products exhaust compartment, said flue products supply duct connected to the flue products exhaust outlet of the furnace so as to deliver hot flue exhaust products therefrom to the said flue products exhaust compartment; a flue products exhaust pipe provided on said main housing in open communication with said flue products exhaust compartment, said flue products exhaust pipe concentrically mounted within said air intake pipe so as to extend therethrough to the exterior of the building to deliver the hot flue products to the outside atmosphere, said flue products exhaust pipe adapted to transmit heat from hot flue exhaust products passing outwardly therethrough to preheat combustion air passing inwardly; and dampers provided in said combustion air intake pipe and said flue products exhaust pipe so as to selectively close said intake air and flue products exhaust pipes when said fans are not running which comprises: switch means connected to the unit which closes upon activation of the motor to enable a circuit controlling operation of a gas supply valve of the heating furnace and disengages the circuit means when the drive means is stopped; and second switch means which is closed to continue the operation of the motor for a period of time after the operation of the heater or furnace are completed to provide complete removal of the hot flue products from the exhaust pipe, unit and the furnace and then opens.

SPECIFIC DESCRIPTION

Referring to FIGS. 1 to 5, the unit 10 for providing heated air adjacent to a furnace 100 and optionally adjacent to hot water heater 200 is described. The unit 10 is similar to that of my U.S. Pat. No. 4,262,608, except that different controls are provided for operation of the unit 10. The unit 10 has a main housing 11 with an air supply compartment 12 (FIG. 4) for the fan 13 mounted on one end of motor 14 shaft 14*a*. At an opposite end of and on the shaft 14*a*, a fan 15 is provided in an exhaust compartment 16. An air intake plenum 17 is provided in gas flow connection with air supply compartment 12 and includes an upright portion 17*a* and a horizontal portion 17*b* (FIG. 4). The plenum 17 is connected to pipe 18 which leads from outside of the building (not shown) as in U.S. Pat. No. 4,262,608 and supplies outside air A to the compartment 12. An exhaust gas connector 19 is connected to manifold 20 (FIG. 1) which removes hot flue gases via pipes 101 and 201 from the furnace 100 and the hot water heater 200, respectively, as can be seen from FIG. 1. The hot flue gases H from the compartment 15 are vented by connector 21 to pipe 22 which vents outside of the building (not shown). Usually the pipes 18 and 22 are in a heat exchange relationship and are concentric with each other as shown; however, they do not have this relationship and can be separate. A motor 14 end switch 23 (FIG. 3) is preferably provided on the motor 14 to be used as shown in FIG. 1 by leads 23*a* and 23*b*. A damper 24 is provided in plenum 17*b* which closes when there is no air A flow. A damper 25 is provided at the inlet to exhaust pipe 22 which closes when there is hot flue gas H moving out pipe 22. The damper 25 is loosely mounted on hook 25*a* and operates by gravity. The damper 24 is pivoted on a pivot 24*a* on an upper portion of plenum 17*b* and operates by gravity. The dampers 24 and 25 prevent air flow from outside of the building when the motor 14 of the unit 10 is not operating. A sail switch 26 with flag 27 is preferably provided in compartment 12 to be used as shown in FIG. 1 to provide operation of the furnace 100 when the air A flow reaches an appropriate level to insure exhaust gas H removal via pipe 22.

FIG. 1 shows a 115 VAC power source which supplies current to a dedicated plug 30 for electrical cord 14*b* for motor 14 by means of electrical cables 31 (neutral) and 32 (positive). Cables 33 and 34 supply current to the furnace circuit 35. The furnace circuit 35 includes a fan 36 and a transformer 37 powered by 110 VAC. The fan 36 operates by a separate circuit (not shown) in the furnace 100 and usually turns on after the air is heated inside the furnace and turns off after the demand for heated air is finished. The transformer 37 connected by cable 38 to fan 36 converts the voltage to 24 VAC and which powers the low voltage (24 volts) portion of the circuit 35 including the thermostat 39 and gas valve 40 which are in series connected by cables 41, 42, 43 and 44. A vacuum diaphragm switch 45 is provided in series in the low voltage circuit which is connected by tube 45*a* to the air supply compartment 12 of the unit 10. As shown, the circuit 35 is in its position prior to operation of the unit 10 or furnace 100, that is the switches are shown in their normally closed (NC) or normally open (NO) positions. Switch 45 activates a solenoid relay 46 via lines 49*a* and 49*b*. Relay 46 activates lines 47 and 48 to relay 55.

The hot water heater 200 is provided with a conventional independent temperature limit switch 50 connected to a sensor 51. Separately a temperature gauge dial 52 is mounted on the heater 200. A tube 53 is connected to the gas compartment of the heater 200 and provides gas pressure through tube 53 to a gas pressure switch 54 which is shown in its normally open position prior to operation of the hot water heater 200. The switch 54 is in a low voltage circuit (24 VAC) in series with a solenoid relay 55 which closes upon activation of switch 54 via cables 56 and 57 connected to transformer 58 which converts 115 VAC to 24 VAC via lines 31 and 32. A warp switch 59 is connected to cables 56 and 57 and 47 and 48 which makes a connection for lines 60 and 61 to power the motor 14 for a period of time after the relays 46 and/or 55 have opened. This is accomplished by a bimetallic strip (not shown) which is heated during operation of the furnace 100 or hot water heater 200 and makes the contact between the cables 60 and 61 and continues to do so until the strip cools to disconnect the cables 60 and 61 (thereby the phrase "warp switch").

OPERATION

For the hot water heater 200, the burner (not shown) is independently operated, full on and full off by an integral thermo-mechanical gas valve (not shown), referred to as the control. This control senses storage water temperature for on-off operation, which are preset by its selection dial 52.

A burner-on operation pressurizes a plugged port opening, from which tube 53 is connected. This extends to the remote diaphragm gas pressure switch 54.

Operation of the hot water heater 200 closes diaphragm gas pressure switch 54, completing electrical circuit from transformer 58 to relay 55 and warp switch 59, simultaneously. Relay-on 55 energizes the 115 VAC outlet 30 for the unit 10. The unit 10 performs through and after cycle to purge the hot flue gases H.

Should the unit 10 fail for any reason to exhaust the products of combustion, a hot flue gas H spillage will occur. The hot gas H impingement on a snap action limit switch(es) (two or more can be wired in series; not shown) which opens the circuit in approximately two minutes and the burner (not shown) is now off until it is relighted. The pilot circuit including limit switch(es) 50 and sensor 51 is a 30 millivolt independent system. Current is generated from only the pilot gas flame impingement upon a thermocouple, comprised of dissimilar metals. If the flame goes out, the circuit to a gas supply valve (not shown) is disconnected. Restarting the heater requires limit switch(es) 50 to self reset and then manually lighting the pilot.

For the furnace, low voltage circuitry is only from furnace 100 integrally mounted transformer 37.

Room thermostat 39 calls for heat closes contacts in 24 v/24 v relay 46, simply jumpering the water heater diaphragm control 54 and energizing any or all of the operational switches 23, 26 or 45 to serve gas valve 40.

Where required, a remote 200 deg. F, snap action limit switch is added attached to furnace 200 draft hood or diverter (not shown). This switch connects in series with the gas valve 40.

Centrifugal switch 23 (or end switch) is an integral part within electric motor 14 and requires near full R.P.M. of motor 14 to hold switch 23 closed. Diaphragm remote switch 45 responds to either pressure or vacuum. Switch 45 interrupts gas valve 40 whenever tube **45*a* has a sufficiently low pressure (vacuum). Sail switch 26 is a mechanical levered micro switch. The flag 27 is moved by air motion sufficient to close switch 26. Use of this switch is an option, to prove sufficient quantities of incoming air into the air compartment 12**.

In operation, the thermostat 39 when closed activates the relay 46 which activates relay 55 to turn on the unit 10. The lower pressure in the unit 10 or in tube **45*a* activates switch 45 to operate the gas valve 40. After the furnace 100 has completed its cycle the thermostat 39 opens again disconnecting relays 46 and 55. The warp switch 55 then continues the operation of the motor 14 in unit 10 for a predetermined period of time to vent the hot flue gas H in the furnace 100**.

In operation of the water heater 200, the switch 54 is closed when the manifold gas pressure from the heater control activates the diaphragm in switch 54 via tube 53 to close the circuit. This activates relay 55 which provides power to the motor 14 in unit 10. Upon completion of the heating by the heater 200, the switch 54 opens, however, the warp switch 59 continues to provide power to the motor 14 for a period of time to vent the hot flue gases H in the hot water heater 200.

Optionally the sail or flag switch 26 or a centrifugal switch 23 can be used in place of or in addition to diaphragm switch 45. Sometimes it is helpful to have redundant switches.

Thus the present invention provides a means for insuring that no hot flue gases H remain in the furnace 100 or hot water heater 200 after operation. Also heat exchange continues to cool the exhaust pipe 22 for a period of time during operation of the warp switch 59.

It is intended that the foregoing description be only illustrative of the present invention and that the present invention be limited only by the hereinafter appended claims.

I claim:

1. An improved control system for a unit which supplies combustion air to a heating furnace and optionally to a hot water heater wherein the unit has a compartmented main housing, said main housing defining a combustion air supply compartment and flue products exhaust compartment therein, said combustion air supply compartment provided with a combustion air intake fan mounted therein and said flue products exhaust compartment provided with a flue products exhaust fan mounted therein; drive means to drive said combustion air intake fan and said flue products exhaust fan; an outside air intake pipe provided on said main housing in open communication with said combustion air supply compartment, said outside air intake pipe configured to extend to the exterior of the building in which it is mounted so as to provide outside air to said combustion air supply compartment; a flue products exhaust pipe provided on said main housing in open communication with said flue products exhaust compartment, said flue products exhaust pipe configured to extend to the exterior of the building to deliver hot flue products to the outside atmosphere; and damper means provided in said combustion air intake pipe and said flue products exhaust pipe so as to selectively close said intake air and flue products exhaust pipes when said fans are not running which comprises:

(a) first switch means connected to the unit which closes upon activation of the drive means to enable a circuit controlling operation of a gas supply valve in the heating furnace and which opens to disengage the circuit when the drive means is stopped; and (b) second switch means which is closed to continue the operation of the drive means to the exhaust fan for a period of time after the operation of the heater or furnace are completed to provide complete removal of the hot flue products from the exhaust pipe, unit and furnace and then opens.

2. The system of claim 1 wherein the first switch means comprises a pneumatic vacuum switch activated by a tube connected to the combustion air supply compartment which senses a change in pressure in the combustion air supply compartment and activates the switch to enable the circuit.

3. The system of claim 1 wherein the first switch means comprises a switch with a flag which moves due to air flow in the combustion air supply compartment and activates the switch to enable the circuit.

4. The system of claim 1 wherein the first switch means comprises a centrifugal switch which is attached to a shaft of a motor of the drive means and which senses rotation of the shaft and is activated to enable the circuit.

5. The system of claim 1 wherein the second switch means is a bimetallic switch which closes the circuit to continue the operation of the drive means for a period of time to provide complete removal of hot flue products after the furnace means completes the heating and then opens.

6. The system of claim 1 wherein the damper means are air pressure controlled.

7. The system of claim 1 wherein the intake pipe and exhaust pipes are horizontal in a basement.

8. The system of claim 7 wherein the pipes are concentric with the intake pipe outside of the exhaust pipe.

9. The system of claim 1 wherein a hot flue products tube exhaust of the hot water heater is connected to the flue products combustion compartment and wherein a third switch means is activated when the hot water heater begins to heat the water and is inactivated when the water is heated and wherein the second switch means continues the operation of the drive means until flue products in the hot water heater and exhaust tube are removed.

10. An improved control system for a unit which preheats combustion air to an area around a heating furnace and optionally air to a hot water heater adjacent the furnace wherein the unit has a compartmented main housing, said main housing defining a combustion air supply compartment and flue products exhaust compartment therein, said combustion air supply compartment provided with a combustion air intake fan mounted therein and said flue products exhaust compartment provided with a flue products exhaust fan mounted therein; a double-shafted drive motor mounted in said main housing so as to simultaneously drive said combustion air intake fan and said flue products exhaust fan; an outside air intake pipe provided on said main housing in open communication with said combustion air supply compartment, said outside air intake pipe configured to extend to the exterior of the building in which it is mounted so as to provide outside air to said combustion air supply compartment; a combustion air supply duct provided on said main housing in open communication with said combustion air supply compartment, said combustion air supply duct configured to convey combustion air to the furnace area; a flue products exhaust supply duct provided on said main housing in open communication with said flue products exhaust compartment, said flue products supply duct connected to the flue products exhaust outlet of the furnace so as to deliver hot flue exhaust products therefrom to the said flue products exhaust compartment; a flue products exhaust pipe provided on said main housing in open communication with said flue products exhaust compartment, said flue products exhaust pipe concentrically mounted within said air intake pipe so as to extend therethrough to the exterior of the building to deliver the hot flue products to the outside atmosphere, said flue products exhaust pipe adapted to transmit heat from hot flue exhaust products passing outwardly therethrough to preheat combustion air passing inwardly; and dampers provided in said combustion air intake pipe and said flue products exhaust pipe so as to selectively close said intake air and flue products exhaust pipes when said fans are not running which comprises:

(a) switch means connected to the unit which closes upon activation of the motor to enable a circuit controlling operation of a gas supply valve in the heating furnace and disengages the circuit when the drive means is stopped; and (b) second switch means which is closed to continue the operation of the motor for a period of time after the operation of the heater or furnace are completed to provide complete removal of the hot flue products from the exhaust pipe, unit and the furnace and then opens.

11. The system of claim 10 wherein the first switch means comprises a pneumatic vacuum switch activated by a tube connected to the combustion air supply compartment which senses a change in pressure the combustion air supply compartment and activates the switch to enable the circuit.

12. The system of claim 10 wherein the first switch means comprises a switch with a flag means due to air flow in the combustion air supply compartment and activates the switch to enable the circuit.

13. The system of claim 10 wherein the first switch means comprises a centrifugal switch which is attached to a shaft of a motor of the drive means and which senses rotation of the shaft and is activated to enable the circuit.

14. The system of claim 10 wherein a second switch means is a bimetallic switch which closes the circuit to continue the operation of the drive means for a period of time to complete removal of hot flue products after the furnace means completes the heating and then opens.

15. The system of claim 10 wherein the dampers are air pressure controlled.

16. The system of claim 10 wherein the intake pipe and exhaust pipes are horizontal in a basement.

17. The system of claim 10 wherein the pipes are concentric with the intake pipe outside of the exhaust pipe.

18. The system of claim 10 wherein wherein a hot flue products tube exhaust of the hot water heater is connected to the flue products combustion compartment and wherein a third switch means is activated when the hot water heater begins to heat the water and is inactivated when the water is heated and wherein the second switch means continues the operation of the drive means until flue products in the hot water heater and exhaust tube are removed.

* * * * *

UNITED STATES PATENT AND TRADEMARK OFFICE

CERTIFICATE OF CORRECTION

PATENT NO. : 4,981,262

DATED : January 1, 1991

INVENTOR(S) : Bert W. Jackson

It is certified that error appears in the above—identified patent and that said Letters Patent is hereby corrected as shown below:

Column 2, line 45, "An" should be --an--.

Column 8, line 12, --in-- should be inserted before "the combustion".

Column 8, line 38, "wherein", second occurrence, should be deleted.

Signed and Sealed this

Nineteenth Day of May, 1992

*Attest:*

DOUGLAS B. COMER

*Attesting Officer*

*Acting Commissioner of Patents and Trademarks*